United States Patent [19]

Broomhall

[11] Patent Number: 4,986,747

[45] Date of Patent: Jan. 22, 1991

[54] PROCESSING CROP MATERIAL

[75] Inventor: Keith Broomhall, Norwich, England

[73] Assignee: Barrico Limited, London, England

[21] Appl. No.: 821,016

[22] Filed: Jan. 21, 1986

[51] Int. Cl.[5] ..... B28B 11/12; B30B 11/16

[52] U.S. Cl. ..... 425/519; 425/122; 425/294; 425/579

[58] Field of Search ..... 100/158 R, 158 C, 907; 264/140, 163, 570, 572; 425/122, 578, 519, 579, 581, 294

[56] References Cited

U.S. PATENT DOCUMENTS

| | | | |
|---|---|---|---|
| 193,942 | 8/1877 | Getter | 100/907 X |
| 625,781 | 5/1899 | Macarthy | 425/579 X |
| 1,088,532 | 2/1914 | Callow et al. | 100/907 X |
| 1,810,864 | 6/1931 | Vogt | 425/122 X |
| 2,000,027 | 5/1935 | Kazanjian | 100/907 X |
| 2,175,342 | 10/1939 | Crawford | 100/907 X |
| 2,253,699 | 8/1941 | Goss | 425/579 X |
| 2,297,244 | 9/1942 | Pfahl | 100/907 X |
| 2,662,246 | 12/1953 | Klugh et al. | 100/907 X |
| 2,675,304 | 4/1954 | Komarek | 100/907 X |
| 2,700,939 | 2/1955 | Liston | 425/122 X |
| 2,987,987 | 6/1961 | Raney et al. | 100/907 X |
| 3,009,413 | 11/1961 | Alexander et al. | 100/158 R |
| 3,023,559 | 3/1962 | Richey et al. | 100/907 X |
| 3,105,434 | 10/1963 | Messing | 100/158 C |
| 3,824,054 | 7/1974 | Harris | 425/237 X |
| 4,122,767 | 10/1978 | Jarrett et al. | 264/140 X |
| 4,237,081 | 12/1980 | Murphy et al. | 264/140 X |
| 4,389,178 | 6/1983 | Komarek | 425/237 |

FOREIGN PATENT DOCUMENTS

| | | | |
|---|---|---|---|
| 988607 | 8/1951 | France | 100/158 C |
| 719551 | 3/1980 | U.S.S.R. | 425/579 |
| 326932 | 3/1930 | United Kingdom . | |
| 708084 | 4/1954 | United Kingdom . | |
| 1178059 | 1/1970 | United Kingdom . | |

*Primary Examiner*—Robert Spitzer

*Attorney, Agent, or Firm*—Gifford, Groh, Sprinkle, Patmore and Anderson

[57] ABSTRACT

In compacting straw and other fibrous material into blocks or briquettes the material is precompressed into a length L of compressed material before feeding to compacting apparatus for compacting the length into the blocks or briquettes.

The compacting apparatus includes a pair of rotary members 10, 11 rotatable about relatively inclined axes 12, 13. A row of pockets 19, 20 extends around each rotary member and the pockets define spaces in which the material is received. The rotary members converge during rotation so that the material is compacted in the spaces.

1 Claim, 2 Drawing Sheets

PROCESSING CROP MATERIAL

Figure 1:
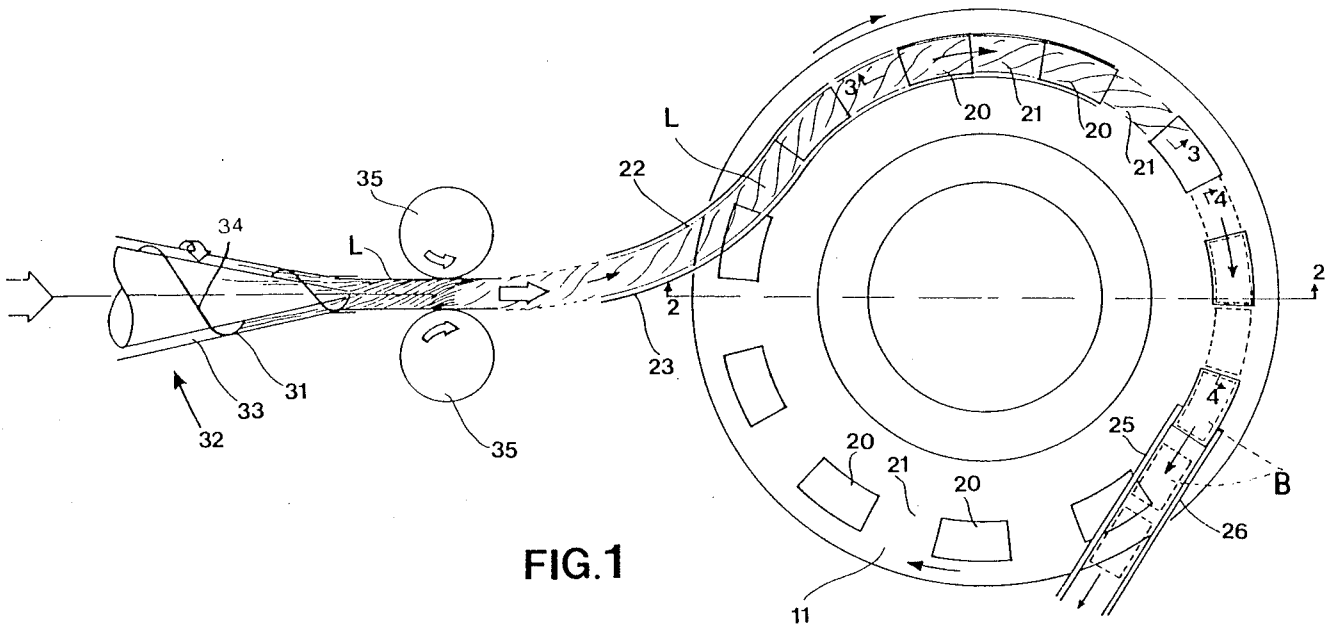

This invention relates to the processing of material and in particular to a method and apparatus for compacting material, such as straw and other loose fibrous material, into discrete blocks or briquettes.

The invention has application to the disposal of crop residues such as straw resulting from the harvesting of grain. It has been proposed to bale such residues into blocks or bales the density of which can be high or low, for use as feed, bedding or fuel. However conventional baling equipment is only able to provide bales of a density such that a high volume of material is required for each unit of heat if the bales are to be used as fuel. If the crop residue could be economically compressed to a density approaching that of say wood a much greater use could be made of the residue as a fuel.

Hitherto apparatus has been proposed for producing high density quantities of straw but such apparatus suffers from various disadvantages. It is very bulky and has a low rate of throughput. The rate of power consumption is high relative to the throughput and the straw must be chopped into short lengths before compression takes place. Such prior apparatus generally involves the use of a reciprocating ram movable along an open-ended cylinder to compress the straw and extrude it.

It has also been proposed to form compressed blocks of hay from loose hay fed between the meshing teeth of a pair of wheels but such apparatus is unable to form blocks of sufficiently high density for economic use.

An object of the present invention is to provide a method and apparatus for compacting or compressing material to produce high density material in which the power requirements are relatively low.

According to one aspect of the invention a method of compacting fibrous material includes the steps of precompressing the material to form a compressed length of the material, feeding the compressed length to compacting apparatus including a pair of rotary members which define between them pockets in which the compressed length is received, compacting the material in the pockets by reducing the sizes of the pockets progressively as the rotary members are rotated until the pockets reach a region of maximum compression of the material, separating the compacted material into discrete blocks or briquettes and discharging the blocks or briquettes from the pockets.

According to another aspect of the invention apparatus for compacting fibrous material comprises precompression means for compressing loose fibrous material to form a length of compressed material, compacting means for compacting the length of material and forming the material into compacted discrete blocks or briquettes, the compaction means including a pair of rotary members rotatable about axes inclined relative to one another, drive means for the rotary members, a row of pockets in which the material is to be received and compacted, the pockets extending in a row around each of the rotary members, the pockets on one rotary member defining with the other rotary member spaces in which the material is received and, during rotation of the rotary members, the members converging and the spaces progressively reducing in size until said spaces reach a minimum size at which maximum convergence occurs and maximum compaction of the material takes place, the compaction means further comprising feed means for feeding the compressed length of material to the pockets and discharge means for discharging compacted discrete blocks or briquettes of material from the pockets.

Preferably the pockets of each rotary member are spaced from each other along a circular row and the rotary members are arranged so that the pockets on one member register with spaces between pockets in the row of pockets of the other rotary member, and a continuous row of pockets is defined by the rotary members.

Conveniently the rotary members in the region in which their maximum convergence arises are closely adjacent one another. Said region of maximum convergence preferably lies in a plane coincident with the intersection of the axes of rotation.

Means may be provided engaging the rotary members to resist the tendency of the members to move apart, at least in the position of maximum compression of the material.

The discharge means may include a plunger defining a portion of the base of each pocket, the plunger being movable towards the open end of the pocket to eject the discrete blocks or briquettes upon the associated pocket passing the region of maximum convergence, during rotation of the rotary members.

The apparatus of the invention is capable of producing a continuous flow of compressed blocks or briquettes of highly compressed material from said pockets with relatively low rate of power consumption.

Preferably the precompression means includes apparatus for forming loose fibrous material into a twisted rope of compressed material. For example the precompressed material, if in the form of straw, may be compressed by the precompression means to give a 30:1 to 10:1 reduction in volume from a feed of uncompressed straw. The compaction apparatus may then provide a further volume reduction of the order of 3:1 to 5:1 to give an overall reduction in volume of the order of 40:1 to 100:1, subject to the initial bulk density of the material.

Figure 2:
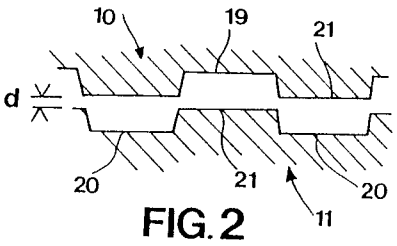
Figure 3:
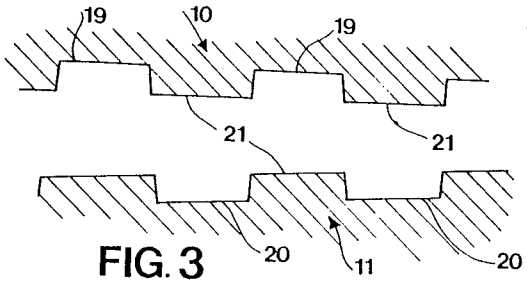
Figure 4:
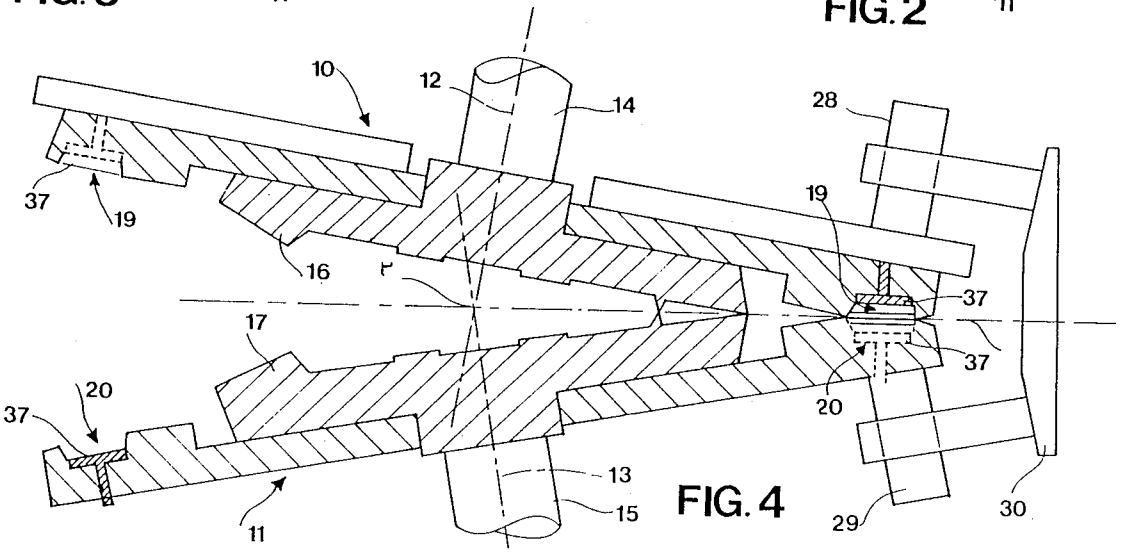

Further features of the invention will appear from the following description of an embodiment of the invention given by way of example only and with reference to the drawings, in which:

FIG. 1 is a schematic plan view of apparatus for compressing crop material into briquettes showing the lower of two rotary members, precompression means, and a feed arrangement, FIG. 2 is a cross-section on the line 2—2 in FIG. 1, showing the two rotary members of the compaction means, FIG. 3 is a cross-section along a circular row of pockets of the apparatus of FIGS. 1 and 2 over one segment 3—3 of the rotary members, and FIG. 4 is a cross-section corresponding to that of FIG. 3 over another segment 4—4 of the rotary members.

Referring to the drawings compaction apparatus includes two rotary members 10 and 11 each rotatable about an axis 12 and 13 respectively, the axes lying in a common plane and being inclined at an acute angle relative to one another. In the illustrated arrangement the angle between the axes 12 and 13 is about 10° but this angle can vary according to the diameter of the members, the nature of the crop material, the degree of compression required and other factors. For example the angle may lie in the range of between 5°-20°.

The members 10 and 11 are arranged to be rotated in the same direction by drive means (not shown). Such drive means may be coupled to a shaft 14 and/or 15 on which the members 10 and 11 are mounted.

In the illustrated arrangement the members 10 and 11 each carry meshing bevel gearing 16 and 17 whereby one member is driven by the other at an identical speed.

Towards the radially outer edge of each of the rotary members 10 and 11 is arranged a row of pockets 19 and 20. The pockets 19 and 20 of each row are spaced from one another along the row a distance to provide a spacing 21 between the pockets approximately equal to the length of each pocket as measured along the circular row of pockets.

The pockets 19 of the member 10 are arranged in relation to the pockets 20 of the member 11 such that the pockets 19 lie over the spaces 21 between the pockets 20, and the pockets 20 lie over the spaces 21 between the pockets 19. Thus the pockets 19 are at the same spacings and of the same lengths as the pockets 20 and the pockets 19 and 20 are located along a row at the same distance from the respective axes 12 and 13 of the members 10 and 11.

Each of the pockets is of part annular form and the pockets approximate to a rectangle, as seen in FIG. 1, or a square in cross-section, and the pockets taper towards their base.

Due to the inclination of the members 10 and 11 and the proximity of the members, the pockets, as they progress along circular paths during rotation of the members, are moved towards and away from each other. At one side of the members 10 and 11 the pockets 19 and 20 are at a maximum spacing from each other. At the opposite side of the members the pockets are a close proximity and at a minimum spacing from each other. In the latter region, i.e. to the right hand side as seen in FIGS. 1 and 2 and as shown in FIG. 4, the surfaces bounding the inner and outer edges of the pockets 19 and 20 may be brought closely adjacent to but not in contact with each other.

It will also be seen from FIG. 2 that the pockets 19 and 20 at their positions of minimum spacings lie symmetrically relative to a plane X coincident with the point of intersection P of the axes 12 and 13 and the bases of the pockets are parallel to said plane X.

The pockets 19 and 20 converge towards one another as they approach their positions of minimum spacing and, as they converge, material located between the pockets 19 and 20 is compressed between and into the pockets until, at the minimum spacing position, substantially all the material is located in the pockets in a compressed condition.

Material to be fed the compaction apparatus is in the form of a precompressed length or lengths L of fibrous crop material such as straw in the nature of a twisted rope of material. The rope is formed from loose straw or other material in a form such as may be discharged from a combine harvester but it should not be necessary of desirable that the loose straw should be chopped into short lengths. The precompressed length L of material may be produced by any convenient means to achieve precompression of the material from the loose form to give a volume reduction of the order of 30:1 to 10:1 before feeding to the compaction apparatus.

In FIG. 1 precompression apparatus is shown schematically at 32 in which the loose material is extruded from a cone 31 after being introduced towards the wider end of the cone. A screw member 34 is located within the cone to define an annular space 33 between the screw member 34 and the cone 31 through which space the material is passed. It will be seen that the annular space 33 reduces in volume in the downstream direction to cause the material passing therethrough to be compressed. Drive means (not shown) causes relative rotation between the cone 31 and the screw member 34 which under the action of the screw formed on the member 34 causes the material to issue in a continuous length in compressed form from the apical end of the cone 31. The length of material L is engaged between a pair of driven rollers 35 as it issues from the cone 31 to help draw the material from the end of the cone and to inhibit rotation of the length L about its longitudinal axis during its passage through the rollers 35. Thus the action of the rollers 35 is to feed the compressed length of material towards the compaction apparatus but in so doing the rollers perform other useful functions. Thus the rollers 35 in drawing the length of material from the cone assist in the passage of the material through the apparatus 32. In addition, by preventing rotation of the length L of material as it passes between the rollers 35 the winding or twisting action of the apparatus 32 on the length L is enhanced up to the point where the length is gripped by the rollers.

A similar effect may be achieved upon omitting the rollers 35 and relying on the gripping of the length L by the rotary members 10 and 11 as it is compressed in the pockets 19 and 20. As the length L is gripped in this way it is drawn out of the cone and assists in causing twisting about its axis, as described, up to the point where the length is gripped.

Material from the rollers 35 or direct from the cone 31 is introduced between the members 10 and 11 between curved guide elements 22 and 23 extending from the region of maximum spacing of the pockets and along the path of the pockets towards the region of minimum spacing of the pockets.

The length L of material fed to the members 10 and 11 may be a continuous length or discontinuous successive lengths.

The arrangement of the pockets 19 and 20 and the degree of compression imparted by the rotary members, which may be of the order of 5:1, ensures that the individual blocks or briquettes B of material formed in the pockets are automatically severed from one another upon release from the pockets along the junction between respective pockets 10 and 20 of the members 10 and 11. It has been found that the surfaces 21 on the members between the pockets may be spaced at said junctions, as seen in FIG. 4, a distance d without preventing the automatic severing action between briquettes B to occur. However, if desired, means may be provided for cutting through the material between adjacent briquettes B if this proves to be necessary.

After the pockets pass through the region of minimum spacing between the pockets (FIG. 4) and diverge, the material in the pockets will expand to project out of the pockets. As this occurs the briquettes B are engaged by discharge guides 25 and 26 or other means, released from the pockets, and diverted from the rotary members 10 and 11 so that the pockets can receive a further charge of material from the feed means 22 and 23. In addition each pocket 19 and 20 may have a movable plunger 37 in its base, the plunger being engaged by a cam (not shown) to move the plunger into the pocket and push the briquette out after it has been formed, for example as the pocket passes between the guide means 25 and 26. The plungers 37 may be returned to the bases of the pockets by engagement with a fresh charge of material to be compacted.

To counteract the loads on the rotary members tending to force the members apart, particularly in the region of minimum spacing between the members, the members 10 and 11 may be engaged by rollers 28 and 29 mounted on a frame 30.

The dimensions of the rotary members, the pockets and the speed of rotation of the members is dependent on various factors but to achieve a throughput of briquette production in the region of ten tonnes per hour the briquettes may be approximately 50 mm wide 70 mm long and 50 mm deep and the rotary members may have 28 pockets rotating at about 75 r.p.m. It has been found that with such an arrangement the briquettes may each weigh about 80 grams.

I claim:

1. Apparatus for compacting fibrous material comprises precompression means for compressing loose fibrous material to form a length of compressed material, compacting means for compacting the length of material and forming the material into compacted discrete blocks or briquettes, the compaction means including a pair of rotary disk members rotatable in the same direction about axes inclined relative to one another, drive means for the rotary members, a row of pockets in the disk members in which the material is to be received and compacted, the pockets extending continuously around the rotary members and the pockets being defined by a row of spaced apart pockets around one of the rotary members and a similar row of spaced apart pockets around the other rotary members, the pockets on one rotary member registering with spaces between the pockets of the other rotary member, the disk members defining between them a wedge-like space in which the length of material is received and, during rotation of the rotary members, the material being progressively compressed in said space and into the pockets as the material approaches a region of maximum convergence of the disk members at which maximum compaction of the material takes place, the compaction means further comprising feed means for feeding the compressed length of material to the space, and discharge means for discharging compacted discrete blocks or briquettes of material from the pockets; wherein the precompression means includes apparatus for forming loose fibrous material into a twisted rope of compressed material.

* * * * *